US011511163B2

(12) United States Patent
Namba et al.

(10) Patent No.: US 11,511,163 B2
(45) Date of Patent: Nov. 29, 2022

(54) GOLF BALL

(71) Applicant: Bridgestone Sports Co., Ltd., Tokyo (JP)

(72) Inventors: Atsushi Namba, Saitamaken (JP); Yusuke Suzuki, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/994,753

(22) Filed: Aug. 17, 2020

(65) Prior Publication Data

US 2021/0052950 A1 Feb. 25, 2021

(30) Foreign Application Priority Data

Aug. 19, 2019 (JP) ..... JP2019-149646

(51) Int. Cl.
*A63B 37/06* (2006.01)
*A63B 37/00* (2006.01)

(52) U.S. Cl.
CPC .... *A63B 37/00922* (2020.08); *A63B 37/0039* (2013.01); *A63B 37/0063* (2013.01); *A63B 37/0076* (2013.01)

(58) Field of Classification Search
CPC ..... A63B 37/0039; A63B 37/0038; A63B 37/0043; A63B 37/0051
USPC ..... 473/373
See application file for complete search history.

(56) References Cited

U.S. PATENT DOCUMENTS

| | | | | |
|---|---|---|---|---|
| 6,197,888 | B1 * | 3/2001 | Luo | C08F 36/06 525/105 |
| 10,035,908 | B1 * | 7/2018 | Luo | B60C 1/0016 |
| 2009/0170634 | A1 * | 7/2009 | Loper | A63B 37/0065 473/373 |
| 2014/0141905 | A1 * | 5/2014 | Ricci | C08G 18/3234 473/376 |
| 2016/0074710 | A1 | 3/2016 | Nakajima et al. | |
| 2016/0166887 | A1 | 6/2016 | Nakajima et al. | |
| 2017/0056732 | A1 | 3/2017 | Watanabe et al. | |
| 2018/0002510 | A1 * | 1/2018 | Comeau | C08L 9/00 |
| 2018/0154219 | A1 | 6/2018 | Watanabe et al. | |

FOREIGN PATENT DOCUMENTS

| | | | |
|---|---|---|---|
| JP | 2015-47502 | A | 3/2015 |
| JP | 2016-112159 | A | 6/2016 |
| JP | 2017-46930 | A | 3/2017 |
| JP | 2018-089103 | A | 6/2018 |

* cited by examiner

*Primary Examiner* — Raeann Gorden
(74) *Attorney, Agent, or Firm* — Sughrue Mion, PLLC

(57) ABSTRACT

In a golf ball having a two-layer core which includes an inner core layer and an outer core layer and having a cover of one or more layer, the outer core layer is formed of an elastomer composition that includes specific amounts of (A) polybutadiene having a 1,2-bond content of 50 to 95%, (B) a photocurable monomer, oligomer or polymer, and (C) a photopolymerizable initiator. The outer core layer has a thickness of from 1.0 to 4.0 mm, and the two-layer core has a surface hardness on the JIS-C scale of from 75 to 95. The ball is provided with a hardness gradient at the core interior, which lowers the spin rate of the ball, has an improved durability to cracking, and production costs for the outer core layer are kept relatively low.

14 Claims, 1 Drawing Sheet

GOLF BALL

CROSS-REFERENCE TO RELATED APPLICATION

This non-provisional application claims priority under 35 U.S.C. § 119(a) on Patent Application No. 2019-149646 filed in Japan on Aug. 19, 2019, the entire contents of which are hereby incorporated by reference.

TECHNICAL FIELD

The present invention relates to a golf ball having a two-layer core composed of an inner core layer and an outer core layer and having a cover of at least one layer.

BACKGROUND ART

In golf balls, the importance of holding down the amount of backspin on driver shots, long-iron shots and also middle-iron shots in order to keep the ball trajectory from rising is already known. Also, there exists numerous prior-art literature that holds down the amount of backspin by a golf ball on shots taken with various clubs by giving the ball core a hardness design in which the core is soft near the center, hard near the outside and the hardness rises from the center toward the surface.

Examples of art for providing the core interior with a given hardness gradient include: (i) single-layer cores obtained by compression-molding a rubber composition containing cis-1,4-polybutadiene as the base rubber, zinc acrylate and an organic peroxide (radical initiator); (ii) single-layer cores obtained by compression-molding a composition like that of (i) to which sulfur, water and the like have also been added; and (iii) cores having a two-layer structure consisting of an inner core layer and an outer core layer which are compression-molded from, respectively, one rubber composition containing cis-1,4-polybutadiene and zinc acrylate, and another rubber composition having a higher zinc acrylate content than the first rubber composition. All of this art uses polybutadiene rubber as the base rubber, the reason being that polybutadiene rubber enables a soft feel and a high rebound performance to both be achieved. In these cores, various approaches are taken to increase the hardness gradient at the core interior from the center to the surface thereof. For example, the approach in (i) suitably adjusts the type and amount of organic peroxide used and the molding temperature; the approach in (ii), as described in JP-A 2015-047502 and JP-A 2016-112159, makes use of the method in (i) and also controls the amounts of sulfur and water; and the approach in (iii), as described in JP-A 2017-046930 and JP-A 2018-089103, enlarges the difference between the zinc acrylate content in the inner core layer and the zinc acrylate content in the outer core layer or further increases the number of layers making up the core.

However, these approaches may lead to a worsening in the durability of the golf ball to impact. In particular, when the zinc acrylate content is increased in an attempt to increase the hardness of the outer core layer, the core has a tendency to become brittle and fail.

Also, designing the core so as to have multiple layers reduces the diameter or thickness per layer, and so a worsening in the durability of the golf ball is unavoidable. Furthermore, in the molding operations for both the inner layer and the outer layer, carrying out compression molding under applied heat takes a relatively long time and a relatively large amount of energy. As a result, increasing the number of layers is generally not desirable because of the even higher processing costs entailed.

SUMMARY OF THE INVENTION

It is therefore an object of the present invention to provide a golf ball which imparts the interior of the core with a hardness gradient and thereby achieves a lower ball spin rate, improves the durability of the ball to cracking, and moreover holds down to a relative degree outer core layer production costs, enabling less expensive production.

As a result of extensive investigations, we have discovered that by designing a golf ball such that the core is formed as two layers—an inner core layer (sometimes referred to below as the "inner core") and an outer core layer (sometimes referred to below as the "outer core"), the outer core layer is formed of an elastomer composition containing (A) 100 parts by weight of a polybutadiene having a 1,2-bond content of 50 to 95%, (B) 5 to 45 parts by weight of a photocurable monomer, oligomer or polymer and (C) 0.1 to 2.0 parts by weight of a photopolymerization initiator, and the thickness of the outer core layer and the surface hardness of the two-layer core are set in specific ranges, the spin rate-lowering effect on full shots with a driver (W #1) becomes larger and the durability of the ball to cracking can be improved.

That is, a golf ball design in which the core has a hardness gradient such that the hardness increases from the center toward the surface of the core can be easily achieved by forming the core as a plurality of layers. Yet, in cores composed of two or more layers, because the outer core layer is formed of a relatively hard rubber material so as to increase its hardness, the durability of the ball to cracking has tended to worsen. In the course of our investigations, we have found that by forming this outer core layer material of an elastomer composition having excellent tensile properties, namely, an elongation at break of 100 to 400%, the composition stretches better than the core-forming rubber compositions used in the prior art, resulting in an improved durability. Moreover, the multilayer core obtained in this invention is provided with a high hardness gradient at the core interior, enabling the amount of backspin on driver shots, long-iron shots and also middle-iron shots to be held down. Finally, in terms of productivity (processability) as well, the cured outer core layer ultimately desired can be completed by UV-irradiating the outer core layer which has been pre-molded over the inner core layer, and so the processability is excellent in this respect.

Accordingly, the present invention provides a golf ball which has a two-layer core having an inner core layer and an outer core layer and has a cover of one or more layer, wherein the outer core layer is formed of an elastomer composition which includes:

(A) 100 parts by weight of polybutadiene having a 1,2-bond content of 50 to 95%, (B) from 4 to 45 parts by weight of a photocurable monomer, oligomer or polymer, and (C) from 0.1 to 2.0 parts by weight of a photopolymerizable initiator;

the outer core has a thickness of from 1.0 to 4.0 mm; and the two-layer core has a surface hardness on the JIS-C hardness scale of from 75 to 95.

In a preferred embodiment of the golf ball of the invention, the inner core layer has a center hardness on the JIS-C hardness scale of from 45 to 60.

In another preferred embodiment of the inventive golf ball, the two-layer core has a difference between the surface hardness and a center hardness, expressed on the JIS-C hardness scale, of from 30 to 45.

In yet another preferred embodiment, the photopolymerization initiator is selected from the group consisting of photo-radical polymerization initiators, photo-cationic polymerization initiators and photo-anionic polymerization initiators.

In still another preferred embodiment, component (B) is a photocurable monomer selected from the group consisting of acrylic acid, acrylic acid esters, acrylic acid salts, methacrylic acids, methacrylic acid esters and methacrylic acid salts.

In a further preferred embodiment, the elastomer composition that forms the outer core has an elongation at break, in tensile testing conducted in accordance with JIS-K 7161-1, of from 100 to 500%.

In a yet further preferred embodiment, the outer core layer is composed of a plurality of layers, at least an outermost layer of which is formed of an elastomer composition that includes components (A) to (C).

Advantageous Effects of the Invention

In the golf ball of the invention, by forming the core of two or more layers—including at least an inner layer and an outer layer, the core interior is provided with a hardness gradient, thus achieving a ball spin rate-lowering effect. In addition, the durability of the ball to cracking is improved and, moreover, production costs for the outer core layer are held down to a relative degree, enabling the ball to be inexpensively produced.

BRIEF DESCRIPTION OF THE DIAGRAM

DESCRIPTION OF THE PREFERRED EMBODIMENTS

The objects, features and advantages of the invention will become more apparent from the following detailed description taken in conjunction with the appended diagrams.

Figure 1:
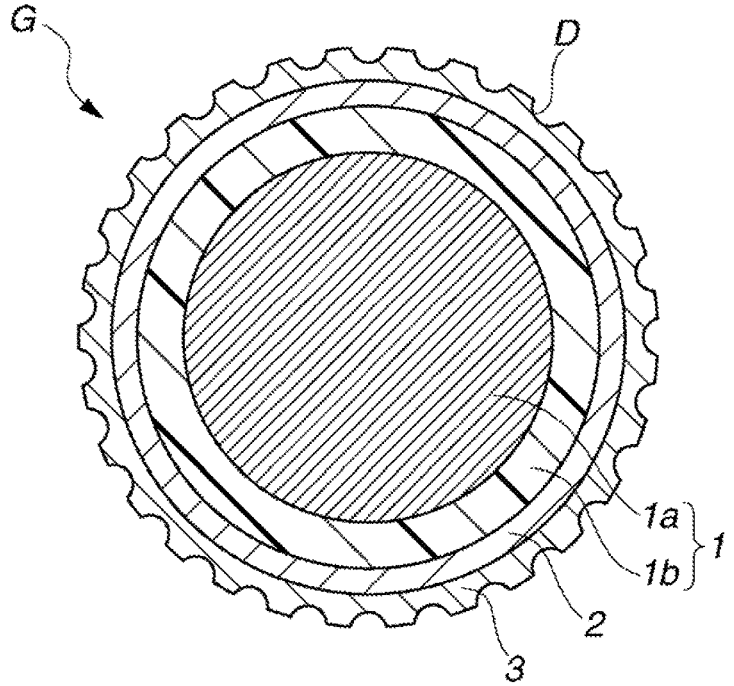
FIG. 1 is a schematic cross-sectional view of a golf ball according to one embodiment of the invention.

The golf ball of the invention has a two-layer core made of an inner core layer and an outer core layer, and has a cover of one or more layer. For example, referring to FIG. 1, the ball may be a golf ball G having an inner core layer 1*a*, an outer core layer 1*b* encasing the inner core layer 1*a*, and a cover made of two layers (an intermediate layer 2 and an outermost layer 3) that encases the core 1 made of these inner and outer core layers. Numerous dimples D are typically formed on the outside surface of the outermost layer 3 in order to enhance the aerodynamic properties. Each of these layers is described in detail below.

As mentioned above, the core used in this invention is made up of at least two layers—an inner core layer and an outer core layer. The inner core layer corresponds to the center core of the golf ball. The inner core layer material is largely composed of a rubber material. Specifically, use can be made of a rubber composition which, in addition to including a base rubber as the chief material and an organic peroxide, also includes a co-crosslinking agent and an inert filler, and optionally includes as well an organic sulfur compound and other ingredients.

Polybutadiene is preferably used as the base rubber. It is desirable for the polybutadiene to have a cis-1,4-bond content on the polymer chain of at least 60 wt %, preferably at least 80 wt %, more preferably at least 90 wt %, and most preferably at least 95 wt %. When the cis-1,4-bond content among the bonds on the molecule is too low, the ball rebound may decrease.

Rubber ingredients other than the above polybutadiene may also be included in the base rubber, so long as doing so does not detract from the advantageous effects of the invention. Such rubber ingredients other than the above polybutadiene include other polybutadienes and other diene rubbers, examples of which include styrene-butadiene rubber, natural rubber, isoprene rubber and ethylene-propylene-diene rubber.

The organic peroxide is not particularly limited, although it is preferable to use an organic peroxide having a one minute half-life temperature of between 110 and 185° C. One or more organic peroxide may be used. The amount of organic peroxide included per 100 parts by weight of the base rubber is preferably at least 0.1 part, and more preferably at least 0.3 part by weight. The upper limit is preferably 5 parts by weight or less, more preferably 4 parts by weight or less, and even more preferably 3 parts by weight or less. A commercial product may be used as the organic peroxide. Specific examples include those available under the trade names Percumyl D, Perhexa C-40, Niper BW and Peroyl L (all products of NOF Corporation), and Luperco 231XL (AtoChem Co.).

Examples of co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 10 parts by weight, preferably at least 15 parts by weight, and more preferably at least 20 parts by weight. The upper limit is typically not more than 60 parts by weight, preferably not more than 50 parts by weight, more preferably not more than 45 parts by weight, and most preferably not more than 40 parts by weight. Too much may make the core too hard, giving the ball an unpleasant feel at impact, whereas too little may lower the rebound.

The inner core layer can be produced by heating and compressing the inner core layer material in the usual manner under vulcanization conditions of at least 140° C. and not more than 180° C. for at least 10 minutes and not more than 60 minutes, and thereby molding a spherical body (inner core).

The inner core has a diameter that is preferably at least 15 mm, more preferably at least 25 mm, and even more preferably at least 35 mm. It is recommended that the upper limit be not more than 38 mm, and preferably not more than 37 mm. When the diameter is too small, the initial velocity of the ball on shots with a driver (W #1) may decrease, as a result of which the intended distance may be unattainable. On the other hand, when the diameter is too large, the durability of the ball to cracking on repeated impact may worsen, or the spin rate-lowering effect on full shots may be inadequate, as a result of which the intended distance may be unattainable.

The inner core has a center hardness, expressed on the JIS-C hardness scale, which is preferably from 45 to 60, and more preferably from 47 to 55. When this value is too large, the spin rate of the ball may rise excessively, resulting in a poor flight, or the ball may have a hard feel at impact. On the other hand, when this value is too small, the durability to cracking on repeated impact may worsen or the feel of the ball at impact may become too soft.

The inner core has a surface hardness, expressed on the JIS-C hardness scale, which is preferably from 75 to 88, and more preferably from 80 to 85. When this value is too large, the durability to cracking on repeated impact may worsen. On the other hand, when this value is too small, the spin rate on full shots may rise, as a result of which the intended distance may be unattainable.

The outer core layer-forming elastomer composition of the invention differs in the ingredients therein from the inner core layer-forming rubber composition. In this invention, the outer core layer is formed of an elastomer composition which includes components (A) to (C) below:

(A) 100 parts by weight of polybutadiene having a 1,2-bond content of 50 to 95%, (B) from 4 to 45 parts by weight of a photocurable monomer, oligomer or polymer, and (C) from 0.1 to 2.0 parts by weight of a photopolymerizable initiator.

Component (A) is a polybutadiene having a 1,2-bond content of from 50 to 95%. That is, the polybutadiene of component (A) is a polybutadiene which includes on the polymer chain from 5 to 50% of bonds other than 1,2-bonds (vinyl structure); i.e., cis-1,4-bonds and trans-1,4-bonds. At a 1,2-bond content below 50%, sufficient reaction under heat or light stimulation may not be obtained.

Commercial products such as the syndiotactic 1,2-polybutadienes (thermoplastic elastomers) available as JSR RB from JSR Corporation may be used as such a polybutadiene. Specific examples include RB810 (melt index, 3 g/10 min at 150° C. and 21.2 N), RB820 (melt index, 3 g/10 min at 150° C. and 21.2 N), RB830 (melt index, 3 g/10 min at 150° C. and 21.2 N) and RB840 (melt index, 3 g/10 min at 150° C. and 21.2 N). The flowability of these polybutadienes is such that, from the standpoint of the processability, the melt index (150° C., 21.2 N) measured by the test method in ASTM-D1238 is preferably at least 1.0 g/10 min, and more preferably at least 2.0 g/10 min. At a melt index below this range, the processability worsens and it may become difficult to form a thin layer in injection molding.

Component (B) is a photocurable monomer, oligomer or polymer. This plays the role of a co-crosslinking agent for the base polymer serving as component (A), or has the role of causing molecules of component (B) to bond to each other, inducing the monomer or oligomer to polymerize. Component (B) is preferably selected from the group consisting of, specifically, acrylic acid, acrylic acid esters, acrylic acid salts, methacrylic acid, methacrylic acid esters and methacrylic acid salts. Examples of the acrylic acid salt or the methacrylic acid include metal salts such as zinc salts and magnesium salts. The use of zinc acrylate or zinc methacrylate is especially preferred.

Component (B) is included in an amount, per 100 parts of component (A), which is at least 5 parts by weight, preferably at least 10 parts by weight, and more preferably at least 15 parts by weight, but is not more than 45 parts by weight, and preferably not more than 40 parts by weight. When the content is too high, a hardness gradient for the overall core is obtained, but the core may end up becoming too hard, worsening the durability. On the other hand, when the content is too low, the rebound of the overall core may decrease.

Component (C) is a photopolymerization initiator and is exemplified primarily by photo-radical initiators, photo-cationic initiators and photo-anionic initiators.

Specific examples of photo-radical polymerization initiators include acetophenone, 3'-hydroxyacetophenone, anthraquinone, sodium anthraquinone-2-sulfonate monohydrate, anisoin, p-anisil, benzyl, benzoin, benzophenone, 2-benzoylbenzoic acid, 4,4'-bis(diethylamino)benzophenone, 4,4'-bis(dimethylamino)benzophenone, benzoin methyl ether, benzoin isopropyl ether, 3,3',4,4'-benzophenonetetracarboxylic dianhydride, benzoin isobutyl ether, benzoin ethyl ether, methyl benzoylformate, 4-benzoylbenzoic acid, 2,2'-bis(2-chlorophenyl)-4,4',5,5'-tetraphenyl-1,2'-biimidazole, methyl 2-benzoylbenzoate, 4-benzoyl 4'-methyldiphenyl sulfide, 2-(1,3-benzodioxol-5-yl)-4,6-bis(trichloromethyl)-1,3,5-triazine and 2-benzyl-2-(dimethylamino)-4'-morpholinobutyrophenone.

Specific examples of photo-cationic polymerization initiators include bis(4-tert-butylphenyl)iodonium hexafluorophosphate, cyclopropyldiphenylsulfonium tetrafluoroborate, dimethylphenacylsulfonium tetrafluoroborate, diphenyliodonium hexafluorophosphate, diphenyliodonium hexafluoroarsenate, diphenyliodonium trifluoromethanesulfonate, 2-(3,4-dimethoxystyryl)-4,6-bis(trichloromethyl)-1,3,5-triazine, 2-[2-(furan-2-yl)vinyl]-4,6-bis(trichloromethyl)-1,3,5-triazine, 4-isopropyl-4'-methyldiphenyliodonium tetrakis(pentafluorophenyl)borate, 2-[2-(5-methylfuran-2-yl)vinyl]-4,6-bis(trichloromethyl)-1,3,5-triazine, 2-(4-methoxyphenyl)-4,6-bis(trichloromethyl)-1,3,5-triazine, 2-(4-methoxystyryl)-4,6-bis(trichloromethyl)-1,3,5-triazine, 4-nitrobenzenediazonium tetrafluoroborate, triphenylsulfonium tetrafluoroborate, triphenylsulfonium bromide, tri-p-tolylsulfonium hexafluorophosphate and tri-p-tolylsulfonium trifluoromethanesulfonate.

Specific examples of photo-anionic polymerization initiators include acetophenone o-benzoyloxime, 1,2-bis(4-methoxyphenyl)-2-oxoethyl cyclohexylcarbamate, nifedipine, 2-nitrobenzyl cyclohexylcarbamate, 2-(9-oxoxanthen-2-yl)propionic acid 1,5,7-triazabicyclo[4.4.0]dec-5-ene salt, 2-(9-oxoxanthen-2-yl)propionic acid 1,5-diazabicyclo[4.3.0]non-5-ene salt and 2-(9-oxoxanthen-2-yl)propionic acid 1,8-diazabicyclo[5.4.0]undec-7-ene salt.

The amount of component (C) included per 100 parts by weight of component A is at least 0.1 part by weight, and preferably at least 0.2 part by weight. The upper limit is 2.0 parts by weight. When this content is too high, a hardness gradient for the overall core is obtained, but the core may end up becoming too hard, worsening the durability. On the other hand, when the content is too low, the curing time may be prolonged and the desired hardness may not be obtained.

The elastomer composition that forms the outer core layer has an elongation at break, in tensile testing conducted in accordance with JIS-K 7161-1, which is preferably in the range of 100 to 500%, and more preferably from 140 to 450%. By selecting, as the outer core layer-forming rubber material, an elastomer composition which is hard and stretches within the specified range, the hardness difference between the core center and core surface can be made large, a reduced spin rate can be achieved and the durability of the ball to cracking can be prevented from worsening.

Production of the outer core layer can be carried out by, for example, an injection molding process in which the outer core layer-forming elastomer composition is injected into the cavity of a mold in which the inner core has been set, following which the molded body is removed from the mold and subjected to UV irradiation, thus forming the outer core layer over the inner core layer. Alternatively, the inner core layer can be encased within the outer core layer by first injecting a thermoplastic elastomer as the outer core layer material into an outer core layer mold and cooling this elastomer composition so as to produce a pair of hemispherical cups, subsequently placing a prefabricated inner core layer in one of the hemispherical cups, capping it with the other hemispherical cup and then carrying out UV irradiation in this state so as to effect curing of the elastomer composition.

The UV irradiation conditions are preferably an irradiation energy of 80 to 150 W and an irradiation time of 10 to 60 seconds.

The outer core layer has a thickness which is preferably from 1.0 to 4.0 mm, and more preferably from 1.2 to 2.0 mm. When the thickness is too large, the initial velocity of the ball on full shots becomes lower and the intended distance may not be achieved. On the other hand, when the thickness is too small, the durability of the ball to cracking on repeated impact may worsen, or the spin rate-lowering effect on full shots may be inadequate, as a result of which the intended distance may not be attainable.

The outer core may be formed as a single layer or as a plurality of layers. When it is formed as a plurality of layers, it is preferable for at least the outermost layer thereof to be formed of an elastomer composition that includes above components (A) to (C).

The surface hardness of the outer core layer, that is, the surface hardness of the overall core, expressed on the JIS-C hardness scale, is at least 75, and preferably at least 85. The upper limit is not more than 95, and preferably not more than 93. When this value is too large, the feel of the ball at impact may become harder or the durability to cracking on repeated impact may worsen. On the other hand, when this value is too small, the spin rate may rise excessively and a good distance may not be obtained.

The hardness difference between the surface of the outer core layer and the center of the inner core layer has a value, expressed on the JIS-C hardness scale, which is preferably at least 30, and more preferably at least 35. The upper limit in this hardness difference is preferably not more than 45, and more preferably not more than 42. When this value is too large, the durability of the ball to cracking on repeated impact may worsen. On the other hand, when this value is too small, the spin rate may rise excessively and a good distance may not be achieved.

The center hardness of the inner core layer refers herein to the hardness measured at the center of the cross-section obtained by cutting the inner core in half through the center. The surface hardness of the outer core layer refers herein to the hardness measured on the spherical surface of the outer core layer.

The golf ball of the invention has a structure that includes the above-described core and a cover of one or more layer. Next, the cover of one or more layer that encases the core is described.

The cover material is not particularly limited. Use can be made of one or more selected from the group consisting of the various types of ionomer resins that are used in golf balls and also thermoplastic elastomers such as urethane-based, amide-based, ester-based, olefin-based and styrene-based thermoplastic elastomers.

The ionomer resin is not particularly limited. Use can be made of known ionomer resins, including commercially available products such as those of the trade names H1706, H1605, H1557, H1601, AM7329, AM7317 and AM7318 available from Dow-Mitsui Polychemicals Co., Ltd.

To realize an even further spin rate-lowering effect in the ball, a highly neutralized ionomeric material may be used in the layer adjoining the core. Specifically, it is preferable to use a material obtained by blending components (i) to (iv) below: 100 parts by weight of a resin component composed of, in admixture, (i) a base resin of (i-1) an olefin-unsaturated carboxylic acid random copolymer and/or a metal ion neutralization product of an olefin-unsaturated carboxylic acid random copolymer mixed with (i-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (ii) a non-ionomeric thermoplastic elastomer in a weight ratio between 100:0 and 50:50;

(iii) from 5 to 80 parts by weight of a fatty acid and/or fatty acid derivative having a molecular weight of from 228 to 1,500; and (iv) from 0.1 to 17 parts by weight of a basic inorganic metal compound capable of neutralizing un-neutralized acid groups in components (i) and (iii).

In particular, when using a mixed material of components (i) to (iv), it is preferable to utilize one in which at least 70% of the acid groups are neutralized.

To obtain the cover in this invention, use can be made of, for example, the method of placing a prefabricated core of two or more layers, depending on the type of ball, within a mold, heating, mixing and melting the above mixture and then injection-molding it over the core, thereby encasing the core periphery with the desired cover. Another cover-forming method that may be used involves molding a pair of hemispherical half-cups beforehand from the cover material of the invention, enveloping the core with these half-cups, and molding under applied pressure at between 120° C. and 170° C. for a period of from 1 to 5 minutes.

When the cover is composed of one layer, the thickness thereof may be set to from 0.3 to 3 mm. When the cover is formed of two layers, the outer cover layer thickness may be set in the range of 0.3 to 2.0 mm and the inner cover layer thickness may be set in the range of 0.3 to 2.0 mm. The Shore D hardnesses of the respective layers making up the cover (cover layers), although not particularly limited, are set to preferably at least 40, and more preferably at least 45, but preferably not more than 70, and more preferably not more than 65.

Numerous dimples are formed on the surface of the outermost layer of the cover. In addition, the cover may be subjected to various types of treatment, such as surface preparation, stamping and painting. When such surface treatment is carried out on the cover formed of the above cover material, the good moldability of the cover surface enables the work to be carried out efficiently.

The golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 9, Comparative Examples 1 to 14

Formation of the Core

Inner core layers for the respective Examples and Comparative Examples were produced by preparing the inner core layer-forming rubber compositions shown in Table 1 and subsequently molding/vulcanizing the compositions under vulcanization conditions of 155° C. and 15 minutes.

TABLE 1

| Rubber composition (pbw) | a1 | a2 | b11 |
|---|---|---|---|
| cis-1,4-Polybutadiene | 100 | 100 | 100 |
| Zinc acrylate | 36 | 36 | 33.6 |
| Zinc oxide | 4 | 4 | 4 |
| Barium sulfate | (amount needed to adjust specific gravity) | | |
| Antioxidant | 0.1 | 0.1 | 0.1 |
| Organic peroxide (1) | 0.6 | 0.6 | 0 |
| Organic peroxide (2) | 1 | 1 | 1.2 |
| Zinc salt of pentachlorothiophenol | 0.6 | 0.6 | 0.1 |
| Water | 1.5 | 5.0 | — |

been set, thereby encasing the inner core with the elastomer composition (outer core layer). The molded body was then removed from the mold and the outer core layer thus formed as a spherical shell on the surface of the inner core was UV-irradiated with a UV lamp at an irradiation energy of 120 W for the irradiation time shown in the same table (0 seconds, 25 seconds or 50 seconds), thereby producing a solid core (overall core) in which a 1.35 mm thick outer core layer was formed. It was possible to carry out injection molding with the elastomer compositions for the respective Examples and Comparative Examples smoothly and without difficulty in each case, indicating that the processability of the outer core layer was good.

With regard to the outer core layer in Comparative Example 14, a rubber composition (composition b11 in Table 1) was rendered, in an unvulcanized state, into sheet form, producing a pair of outer core layer-forming sheets, and these sheets were stamped using a die provided with a hemispherical protrusion. The stamped rubber composition in a semi-vulcanized state thus obtained was then placed over the inner core and vulcanized at 155° C. for 15 minutes, producing a two-layer core consisting of an inner layer and an outer layer. Because a rubber composition was thus used in Comparative Example 14, injection molding could not be carried out, necessitating the complicated steps just described. Hence, the processability of the outer core layer was judged to be poor.

TABLE 2

| | | b1 | b2 | b3 | b4 | b5 | b6 | b7 | b8 | b9 | b10 |
|---|---|---|---|---|---|---|---|---|---|---|---|
| Composition (pbw) | (A) 1,2-Polybutadiene | 100 | 100 | 100 | 100 | 100 | 100 | 100 | 100 | 100 | 100 |
| | (B) Zinc acrylate | 0 | 0 | 0 | 15 | 15 | 15 | 30 | 30 | 30 | 50 |
| | (C) Benzophenone | 0.5 | 1.0 | 1.5 | 0.5 | 1.0 | 1.5 | 0.5 | 1.0 | 1.5 | 1.5 |
| Irradiation time | 0 seconds | b1-1 | b2-1 | b3-1 | | | | | | | b10-1 |
| | 25 seconds | b1-2 | b2-2 | b3-2 | b4-2 | b5-2 | b6-2 | b7-2 | b8-2 | b9-2 | b10-2 |
| | 50 seconds | b1-3 | b2-3 | b3-3 | b4-3 | b5-3 | b6-3 | | | | b10-3 |

Details on the ingredients in Table 1 are as follows.

cis-1,4-Polybutadiene: Available under the trade name "BR 51" from JSR Corporation Zinc acrylate: Available from Nippon Shokubai Co., Ltd.

Zinc oxide: Available as "Zinc Oxide Grade 3" from Sakai Chemical Co., Ltd.

Barium sulfate: Available as "Barico #100" from Hakusui Tech

Antioxidant: 2-2-Methylenebis(4-methyl-6-butylphenol), available under the trade name "Nocrac NS-6" from Ouchi Shinko Chemical Industry Co., Ltd.

Organic Peroxide (1): Dicumyl peroxide, available under the trade name "Percumyl D" from NOF Corporation Organic Peroxide (2): A mixture of 1,1-di(t-butylperoxy) cyclohexane and silica, available under the trade name "Perhexa C-40" from NOF Corporation Zinc salt of pentachlorothiophenol:

Available from Wako Pure Chemical Industries Co., Ltd.

Distilled water: Available from Wako Pure Chemical Industries Co., Ltd.

Next, the elastomer compositions shown in Table 2 were prepared for the Examples and Comparative Examples, following which in each case the elastomer composition was injected into a mold cavity within which the inner core had Details on the ingredients mentioned in Table 2 are as follows.

1,2-Polybutadiene: Available as "RB840" from JSR Corporation; Shore D hardness, 52; melt index (150° C., 21.2 N), 3 g/10 min)

Zinc acrylate: Available from Nippon Shokubai Co., Ltd.

Benzophenone (photo-radical polymerization initiator):

Available as "B0083" from Tokyo Chemical Industry Co., Ltd.

Next, the ionomer resin shown in Table 3, which is a material common to all the Examples, was injection-molded over the 38.7 mm diameter cores obtained as described above, thereby producing a sphere encased by an intermediate layer having a thickness of 1.15 mm (intermediate layer-encased sphere). Next, the thermoplastic polyurethane resin shown in Table 3, which is a material common to all the Examples, was injection-molded over the intermediate layer-encased sphere, thereby producing a sphere encased by an outermost layer having a thickness of 0.85 mm. This outermost layer-encased sphere was a four-piece golf ball having a diameter of 42.7 mm. Dimples common to all of the Examples were formed at this time on the ball surface in each Example and Comparative Example.

TABLE 3

| Resin material (amounts are in parts by weight) | c-1 | d-1 |
|---|---|---|
| Surlyn 8150 | 60 | |
| Surlyn 9150 | 40 | |
| Pandex 8290 | | 67 |
| Pandex 8283 | | 22 |
| Polyester elastomer | | 11 |
| Isocyanate compound | | 6.7 |
| Polyethylene wax | | 2.4 |
| Titanium dioxide | | 2.9 |

Trade names for the materials mentioned in Table 3 are as follows.

Surlyn™8150, Surlyn™9150:

Ionomer resins available from E.I. DuPont de Nemours & Co.

Pandex™ 8290, Pandex™ 8283:

Ether-type thermoplastic polyurethanes available from DIC Covestro Polymer, Ltd.

Polyester Elastomer: Available as Hytrel® 4001, from DuPont-Toray Co., Ltd.

Isocyanate compound: 4,4-Diphenylmethane diisocyanate

Polyethylene wax: Available under the trade name "Sanwax 161-P" from Sanyo Chemical Industries, Ltd.

Titanium dioxide: Available from Sakai Chemical Co., Ltd.

In each of the resulting golf balls, the following methods were used to evaluate the center hardness of the inner core, the surface hardness of the outer core, the elongation at break of the outer core material and the processability during molding of the outer core. The results are presented below in Table 4 (Examples) and Table 5 (Comparative Examples).

JIS-C Hardnesses at Center of Inner Core and Surface of Outer Core

The center hardness of the inner core was measured as the center hardness in the cross-section obtained by cutting the inner core in half through the center. The surface hardness of the outer core was measured by perpendicularly pressing the indenter of a durometer against the surface of the overall core. Each of the measurements was taken using the spring-type durometer (JIS-C type) specified in JIS K 6301-1975.

Elongation at Break (%) in Tensile Test

Test pieces were fabricated by heating the outer core layer elastomers shown in Table 2 at 140° C. for 1 minute and then cooling at 10° C. for 10 minutes to produce sheets, and subsequently UV-irradiating the sheets under the conditions shown in the same table. Tensile testing was carried out on the resulting test pieces in accordance with JIS-K 7161-1, and the elongation at break (%) was measured.

The flight performance and durability to cracking under repeated impact of each of the golf balls were evaluated by the methods described below. The results are presented in Table 4. All these measurements were carried out in a 23° C. environment.

Flight Performance (Spin Rate)

A driver (W #1) was mounted on a golf swing robot, and the spin rate of the ball immediately after being struck at a head speed of 45 m/s was measured using an apparatus for measuring the initial conditions. The club used was the TourB XD-5 Driver (loft angle, 9.5°) manufactured by Bridgestone Sports Co., Ltd.

In addition, a middle iron (number six iron) was mounted on a golf swing robot, and the spin rate of the ball immediately after being struck at a head speed of 42 m/s was measured using an apparatus for measuring the initial conditions. The club used was the TourB X-CB I #6 manufactured by Bridgestone Sports Co., Ltd.

Durability to Repeated Impact

The balls in the respective Examples were repeatedly struck at a head speed (HS) of 40 m/s with a driver (W #1) similar to that mentioned above mounted on a golf swing robot. The durability index in each Example was calculated relative to an arbitrary index of 100 for the number of shots at which the initial velocity of the ball in Comparative Example 10 fell to or below 97% of the average initial velocity for the first ten shots. The durability index in each Example was an average value obtained for three sample balls.

TABLE 4

| | | Example | | | | | | | | |
|---|---|---|---|---|---|---|---|---|---|---|
| | | 1 | 2 | 3 | 4 | 5 | 6 | 7 | 8 | 9 |
| Inner core | Composition | a1 | a1 | a1 | a1 | a1 | a1 | a1 | a1 | a1 |
| | Diameter (mm) | 36.0 | 36.0 | 36.0 | 36.0 | 36.0 | 36.0 | 36.0 | 36.0 | 36.0 |
| | Center hardness (JIS-C) | 50 | 50 | 50 | 50 | 50 | 50 | 50 | 50 | 50 |
| Outer core | Composition & Treatment | b4-2 | b4-3 | b5-2 | b5-3 | b6-2 | b6-3 | b7-2 | b8-2 | b9-2 |
| | Diameter (mm) | 38.7 | 38.7 | 38.7 | 38.7 | 38.7 | 38.7 | 38.7 | 38.7 | 38.7 |
| | Thickness (mm) | 1.35 | 1.35 | 1.35 | 1.35 | 1.35 | 1.35 | 1.35 | 1.35 | 1.35 |
| | Surface hardness (JIS-C) | 88 | 88 | 88 | 88 | 87 | 88 | 91 | 91 | 90 |
| | Tensile test: Elongation at break (%) | 318 | 179 | 172 | 194 | 269 | 146 | 318 | 220 | 251 |
| | Processability | good | good | good | good | good | good | good | good | good |
| Core | Surface hardness – Center hardness (JIS-C) | 38 | 38 | 38 | 38 | 37 | 38 | 41 | 41 | 40 |
| Intermediate layer | Composition | c1 | c1 | c1 | c1 | c1 | c1 | c1 | c1 | c1 |
| Outermost layer | Composition | d1 | d1 | d1 | d1 | d1 | d1 | d1 | d1 | d1 |
| Ball properties | Spin rate on W#1 shots (rpm) | 2,727 | 2,715 | 2,681 | 2,712 | 2,765 | 2,692 | 2,670 | 2,597 | 2,623 |
| | Spin rate on I#6 shots (rpm) | 5,746 | 5,700 | 5,694 | 5,701 | 5,766 | 5,689 | 5,656 | 5,610 | 5,642 |
| | Ball durability (index) | 109 | 104 | 104 | 105 | 108 | 103 | 108 | 105 | 106 |

TABLE 5

| | | Comparative Example | | | | | | |
|---|---|---|---|---|---|---|---|---|
| | | 1 | 2 | 3 | 4 | 5 | 6 | 7 |
| Inner core | Composition | a1 | a1 | a1 | a1 | a1 | a1 | a1 |
| | Diameter (mm) | 36.0 | 36.0 | 36.0 | 36.0 | 36.0 | 36.0 | 36.0 |
| | Center hardness (JIS-C) | 50 | 50 | 50 | 50 | 50 | 50 | 50 |
| Outer core | Composition & Treatment | b1-1 | b1-2 | b1-3 | b2-1 | b2-2 | b2-3 | b3-1 |
| | Diameter (mm) | 38.7 | 38.7 | 38.7 | 38.7 | 38.7 | 38.7 | 38.7 |
| | Thickness (mm) | 1.35 | 1.35 | 1.35 | 1.35 | 1.35 | 1.35 | 1.35 |
| | Surface hardness (JIS-C) | 86 | 86 | 87 | 87 | 86 | 87 | 87 |
| | Tensile test: Elongation at break (%) | 491 | 380 | 372 | 427 | 379 | 363 | 437 |
| | Processability | good | good | good | good | good | good | good |
| Core | Surface hardness – Center hardness (JIS-C) | 36 | 36 | 37 | 37 | 36 | 37 | 37 |
| Intermediate layer | Composition | c1 | c1 | c1 | c1 | c1 | c1 | c1 |
| Outermost layer | Composition | d1 | d1 | d1 | d1 | d1 | d1 | d1 |
| Ball properties | Spin rate on W#1 shots (rpm) | 2,890 | 2,844 | 2,833 | 2,838 | 2,863 | 2,809 | 2,869 |
| | Spin rate on I#6 shots (rpm) | 5,900 | 5,846 | 5,825 | 5,853 | 5,852 | 5,827 | 5,858 |
| | Ball durability (index) | 115 | 111 | 111 | 113 | 111 | 111 | 113 |

| | | Comparative Example | | | | | | |
|---|---|---|---|---|---|---|---|---|
| | | 8 | 9 | 10 | 11 | 12 | 13 | 14 |
| Inner core | Composition | a1 | a1 | a1 | a1 | a1 | a2 | a1 |
| | Diameter (mm) | 36.0 | 36.0 | 36.0 | 36.0 | 36.0 | 38.7 | 36.0 |
| | Center hardness (JIS-C) | 50 | 50 | 50 | 50 | 50 | 50 | 50 |
| Outer core | Composition & Treatment | b3-2 | b3-3 | b10-1 | b10-2 | b10-3 | none | b11 |
| | Diameter (mm) | 38.7 | 38.7 | 38.7 | 38.7 | 38.7 | — | 38.7 |
| | Thickness (mm) | 1.35 | 1.35 | 1.35 | 1.35 | 1.35 | — | 1.35 |
| | Surface hardness (JIS-C) | 86 | 86 | 90 | 91 | 92 | 85 | 89 |
| | Tensile test: Elongation at break (%) | 359 | 286 | 290 | 150 | 90 | 65 | 60 |
| | Processability | good | good | good | good | good | — | poor |
| Core | Surface hardness – Center hardness (JIS-C) | 36 | 36 | 40 | 41 | 42 | 34 | 39 |
| Intermediate layer | Composition | c1 | c1 | c1 | c1 | c1 | c1 | c1 |
| Outermost layer | Composition | d1 | d1 | d1 | d1 | d1 | d1 | d1 |
| Ball properties | Spin rate on W#1 shots (rpm) | 2,833 | 2,836 | 2,371 | 2,409 | 2,288 | 2,846 | 2,500 |
| | Spin rate on I#6 shots (rpm) | 5,845 | 5,828 | 5,370 | 5,400 | 5,300 | 5,850 | 5,500 |
| | Ball durability (index) | 111 | 109 | 100 | 98 | 97 | 98 | 98 |

Figure 2:
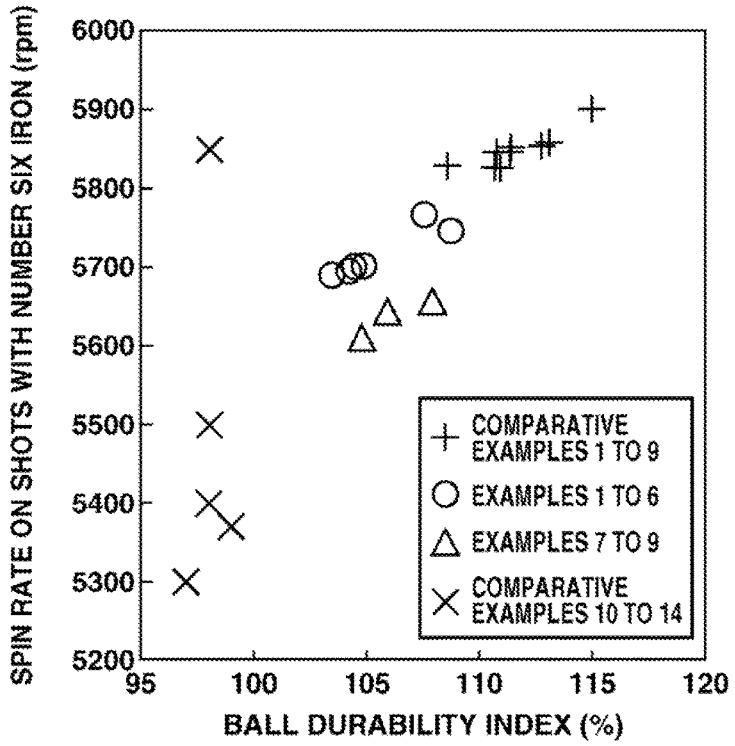
FIG. 2 is a graph showing the spin rates and durabilities of the golf balls in the Examples and the Comparative Examples when shot with a number six iron.

FIG. 2 shows a graph of the spin rates and durabilities of the golf balls in the Examples and the Comparative Examples on shots taken with a number six iron.

The following is apparent from the results in Tables 4 and 5 and FIG. 2.

Although the balls in Example 1 and Comparative Example 9 had the same durability index, the backspin rate on shots with a number six iron was too high in Comparative Example 9. By contrast, in Example 1, the backspin rate on shots with a number six iron was held down, which was desirable.

As in Example 1, the balls in Examples 2 to 9 also had excellent durabilities. Moreover, the backspin rates on shots with a number six iron were suitably held down, which was desirable.

The balls in Comparative Examples 10 to 14 all had inferior durabilities.

Japanese Patent Application No. 2019-149646 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a two-layer core having an inner core layer and an outer core layer and a cover of one or more layer, wherein the outer core layer is formed of an elastomer composition which consists of:

(A) 100 parts by weight of polybutadiene having a 1,2-bond content of 90 to 95%, (B) from 4 to 45 parts by weight of a photocurable monomer, oligomer or polymer, and (C) from 0.1 to 2.0 parts by weight of a photopolymerizable initiator;

the outer core layer has a thickness of from 1.0 to 4.0 mm; and the two-layer core has a surface hardness on the JIS-C hardness scale of from 75 to 95, wherein the photocurable monomer is selected from the group consisting of acrylic acid, acrylic acid esters, acrylic acid salts, methacrylic acids, methacrylic acid esters and methacrylic acid salts.

2. The golf ball of claim 1, wherein the inner core layer has a center hardness on the JIS-C hardness scale of from 45 to 60.

3. The golf ball of claim 1, wherein the two-layer core has a difference between the surface hardness and a center hardness, expressed on the JIS-C hardness scale, of from 30 to 45.

4. The golf ball of claim 1, wherein the photopolymerization initiator is selected from the group consisting of photo-radical polymerization initiators, photo-cationic polymerization initiators and photo-anionic polymerization initiators.

5. The golf ball of claim 1, wherein the elastomer composition that forms the outer core has an elongation at break, in tensile testing conducted in accordance with JIS-K 7161-1, of from 100 to 500%.

6. The golf ball of claim 1, wherein the outer core layer is composed of a plurality of layers, at least an outermost layer of which is formed of an elastomer composition comprising components (A) to (C).

7. The golf ball of claim 1, wherein a fatty acid (meth) acrylic acid salt is not included in all layers of the inner core layer and the outer core layer and the cover of one or more layer.

8. A golf ball comprising a two-layer core having an inner core layer and an outer core layer and a cover of one or more layer, wherein the outer core layer is formed of an elastomer composition which includes (A) 100 parts by weight of polybutadiene having a 1,2-bond content of 90 to 95%, (B) from 4 to 45 parts by weight of a photocurable monomer, oligomer or polymer, and (C) from 0.1 to 2.0 parts by weight of a photopolymerizable initiator;

the outer core layer has a thickness of from 1.0 to 4.0 mm; and the two-layer core has a surface hardness on the JIS-C hardness scale of from 75 to 95, wherein the photocurable monomer is selected from the group consisting of acrylic acid, acrylic acid esters, acrylic acid salts, methacrylic acids, methacrylic acid esters and methacrylic acid salts.

9. The golf ball of claim 8, wherein the inner core layer has a center hardness on the JIS-C hardness scale of from 45 to 60.

10. The golf ball of claim 8, wherein the two-layer core has a difference between the surface hardness and a center hardness, expressed on the JIS-C hardness scale, of from 30 to 45.

11. The golf ball of claim 8, wherein the photopolymerization initiator is selected from the group consisting of photo-radical polymerization initiators, photo-cationic polymerization initiators and photo-anionic polymerization initiators.

12. The golf ball of claim 8, wherein the elastomer composition that forms the outer core has an elongation at break, in tensile testing conducted in accordance with JIS-K 7161-1, of from 100 to 500%.

13. The golf ball of claim 8, wherein the outer core layer is composed of a plurality of layers, at least an outermost layer of which is formed of an elastomer composition comprising components (A) to (C).

14. The golf ball of claim 8, wherein a fatty acid (meth) acrylic acid salt is not included in all layers of the inner core layer and the outer core layer and the cover of one or more layer.

* * * * *